US009982924B2

(12) United States Patent
Kawano et al.

(10) Patent No.: US 9,982,924 B2
(45) Date of Patent: May 29, 2018

(54) EJECTOR AND HEAT PUMP APPARATUS

(71) Applicant: Panasonic Intellectual Property Management Co., Ltd., Osaka (JP)

(72) Inventors: Bunki Kawano, Osaka (JP); Tomoichiro Tamura, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 8 days.

(21) Appl. No.: 15/220,379

(22) Filed: Jul. 26, 2016

(65) Prior Publication Data

US 2017/0067673 A1 Mar. 9, 2017

(30) Foreign Application Priority Data

Sep. 7, 2015 (JP) ..... 2015-175309

(51) Int. Cl.
*F25B 41/00* (2006.01)
*F25B 13/00* (2006.01)

(52) U.S. Cl.
CPC ..... *F25B 41/00* (2013.01); *F25B 13/00* (2013.01); *F25B 2341/001* (2013.01)

(58) Field of Classification Search
CPC ..... F25B 2341/001; F25B 1/06; F25B 9/08; F04F 5/04; F04F 43/00
USPC ..... 62/500
See application file for complete search history.

(56) References Cited

U.S. PATENT DOCUMENTS 9,726,405 B2 * 8/2017 Kawano ..... F04F 5/04
2016/0033183 A1 2/2016 Kawano et al.

FOREIGN PATENT DOCUMENTS

JP 6-002964 1/1994
WO 2015/019563 2/2015

* cited by examiner

*Primary Examiner* — Cassey D Bauer
(74) *Attorney, Agent, or Firm* — McDermott Will & Emery LLP

(57) ABSTRACT

An ejector includes an atomization mechanism that is disposed at an end of a first nozzle and that atomizes a working fluid in a liquid phase while maintaining the liquid phase. The atomization mechanism includes an orifice and a collision plate. When the collision plate is orthographically projected onto a projection plane, in a projection of the collision plate, at least one point on a contour of the collision surface is disposed closer to a reference point than a second reference line, which is a line including the collision end point and perpendicular to the first reference line.

7 Claims, 13 Drawing Sheets

EJECTOR AND HEAT PUMP APPARATUS

BACKGROUND

1. Technical Field

The present disclosure relates to an ejector including a single-fluid atomization nozzle and a heat pump apparatus including the ejector.

2. Description of the Related Art

Atomization technologies are applied to energy-related technologies, such as combustion of liquid fuels; and to various industrial fields, such as spray painting, spray drying, moisture adjustment, spraying of agricultural chemicals, and fire extinguishing. Performance required for a spray nozzle varies depending on the use of the spray nozzle. Various atomization methods for spray nozzles have been developed. Examples of such methods include turbulent atomization, atomization including breaking of a thin film formed by spraying, centrifugal atomization, atomization including forming and breaking a liquid thread, and atomization using interaction between two fluids.

Ejectors are used as decompression means of various apparatuses, such as vacuum pumps and refrigeration cycle apparatuses. As illustrated in FIG. 9, a refrigeration cycle apparatus 200 described in Japanese Patent No. 3158656 includes a compressor 102, a condenser 103, an ejector 104, a separator 105, and an evaporator 106. The ejector 104 receives a refrigerant liquid as a drive flow from the condenser 103, sucks in and pressurizes a refrigerant vapor supplied from the evaporator 106, and ejects the refrigerant liquid and the refrigerant vapor toward the separator 105. The separator 105 separates the refrigerant liquid and the refrigerant vapor from each other. The compressor 102 sucks in the refrigerant vapor pressurized by the ejector 104. Thus, the compression work to be done by the compressor 102 is reduced and the COP (coefficient of performance) of a refrigeration cycle is improved.

As illustrated in FIG. 10, the ejector 104 includes a nozzle 140, a suction port 141, a mixer 142, and a pressurizer 143. A plurality of connection ports 144, through which the inside of the nozzle 140 is connected to the outside of the nozzle 140, are disposed near the outlet of the nozzle 140. The refrigerant vapor is sucked into the ejector 104 through the suction ports 141. A part of the refrigerant vapor sucked into the ejector 104 flows to the inside of the nozzle 140 through the connection ports 144. The nozzle 140 of the ejector 104 has a reduced-diameter portion near the outlet thereof. In the reduced-diameter portion, the flow velocity of the refrigerant increases and the pressure of the refrigerant decreases. Accordingly, the phase of the refrigerant (drive flow), which is supplied to the nozzle 140, changes from a liquid phase to a vapor-liquid two-phase in the reduced-diameter portion. However, when a supercooled liquid is used as a drive flow, the drive flow cannot be atomized because the phase change does no occur.

As illustrated in FIG. 11, an ejector 300 described in International Publication No. 2015/019563 includes a first nozzle 301, a second nozzle 302, an atomization mechanism 303, and a mixer 304. A working fluid in a liquid phase is supplied to the first nozzle 301. A working fluid in a vapor phase is sucked into the second nozzle 302. The atomization mechanism 303 is disposed at an end of the first nozzle 301 and atomizes the working fluid in the liquid phase while maintaining the liquid phase. The atomized working fluid generated by the atomization mechanism 303 and the working fluid in the vapor phase sucked into the second nozzle 302 are mixed in the mixer 304, and thereby a merged fluid flow is generated.

As illustrated in FIG. 12, the atomization mechanism 303 includes an ejection section 306 and a collision surface forming section 307. The ejection section 306 is attached to the end of the first nozzle 301. The ejection section 306 has a plurality of orifices 308. The orifices 308 extend through a bottom part of the ejection section 306, which has a tubular shape, so as to connect the first nozzle 301 to the mixer 304. Through the orifices 308, a refrigerant liquid is ejected from the first nozzle 301 toward the collision surface forming section 307. The collision surface forming section 307 has a collision surface 309, with which a jet from the ejection section 306 is to collide. The collision surface forming section 307 includes a shaft portion 310 and a flared portion 311.

SUMMARY

The performance of an ejector depends on whether transfer of momentum between a drive flow and a suction flow can be efficiently performed. In this respect, the ejector 300 described in International Publication No. 2015/019563 has room for further improvement.

One non-limiting and exemplary embodiment provides a technology for improving the performance of an ejector.

In one general aspect, the techniques disclosed here feature an ejector including a first nozzle to which a working fluid in a liquid phase is supplied, a second nozzle into which a working fluid in a vapor phase is sucked, an atomization mechanism that is disposed at an end of the first nozzle and that atomizes the working fluid in the liquid phase while maintaining the liquid phase, and a mixing space in which the atomized working fluid in the liquid phase generated in the atomization mechanism and the working fluid in the vapor phase sucked into the second nozzle are mixed to generate a merged fluid flow. The atomization mechanism includes an orifice, and a collision plate that is disposed on an extended line of a center axial line of the orifice. The collision plate has a collision surface that is inclined with respect to the center axial line of the orifice. When the collision plate is orthographically projected onto a projection plane, at least one point on a contour of the collision surface is disposed closer to a reference point than a second reference line in a projection of the collision plate, where the reference point is an intersection of the extended line of the center axial line of the orifice with the collision surface, a reference plane is a plane that includes the center axial line of the orifice and that perpendicularly intersects with the collision surface, a collision end point is an intersection of the reference plane with the contour of the collision surface, a first reference line is a line segment that connects the reference point with the collision end point, the second reference line is a line that includes the collision end point and that is perpendicular to the first reference line, and the projection plane is a plane that includes the first reference line and that is perpendicular to the reference plane.

With the technology described above, the performance of the ejector is improved.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
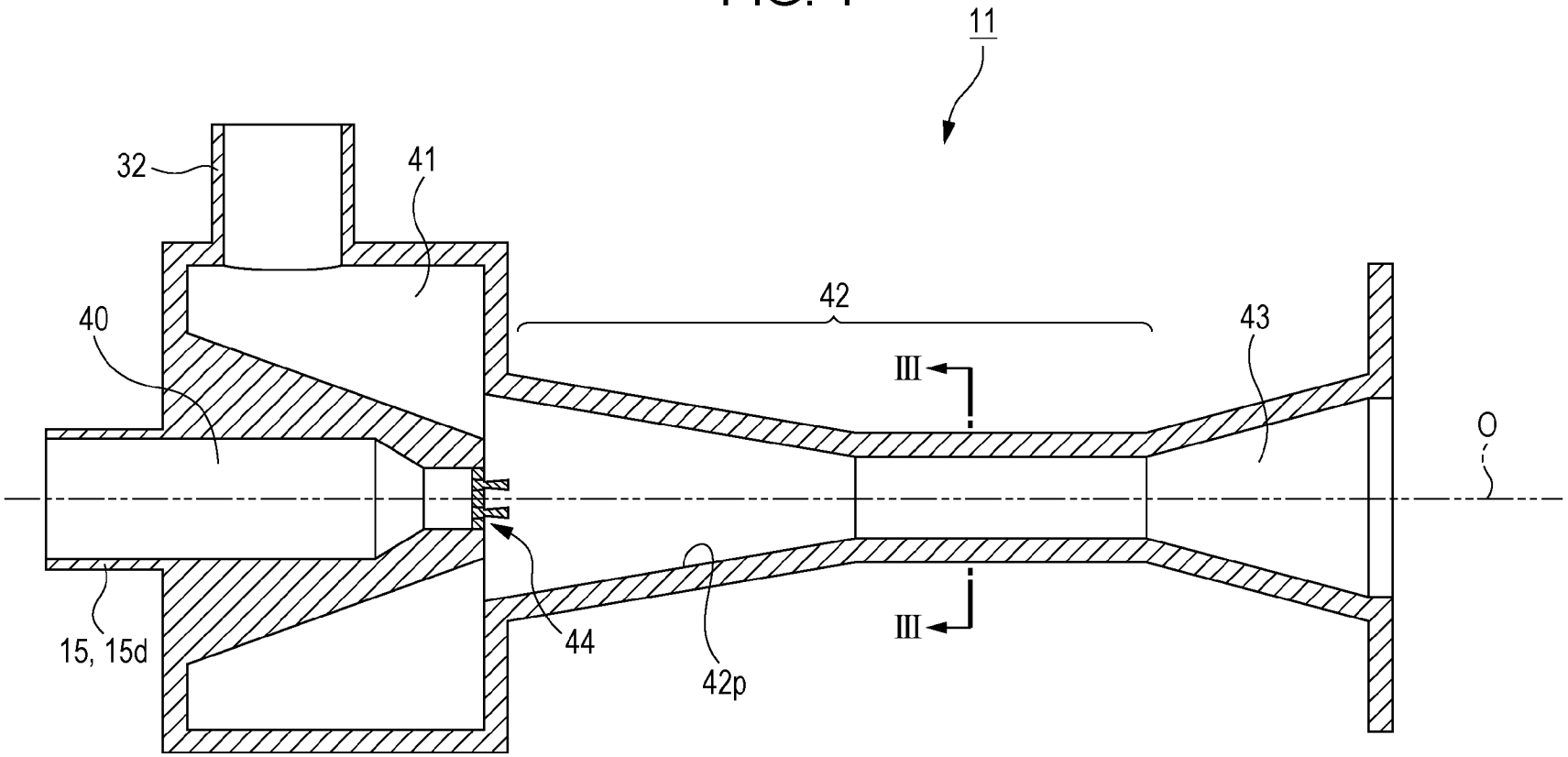
FIG. 1 is a sectional view of an ejector according to an embodiment of the present disclosure.

Underlying Knowledge Forming Basis of the Present Disclosure

The performance of an ejector depends on whether transfer of momentum between a drive flow and a suction flow is performed efficiently. When the drive flow is a flow of a liquid and the suction flow is a flow of a gas, it is necessary to enlarge a vapor-liquid interface that contributes to transfer of momentum. To maximize the efficiency of an ejector (to minimize driving energy, that is, to make the total condensation amount equal to the amount of sucked vapor), it is necessary to apply a single-fluid atomization technology to the ejector.

With the atomization mechanism 303 of the ejector 300 described in International Publication No. 2015/019563, a jet from the ejection section 306 collides with the collision surface 309 and becomes a thin liquid film. The liquid film is ejected to a space in the mixer 304 and breaks into a large number of particles due to the instability phenomenon of the liquid film itself. The thinner the liquid film, the smaller the generated particles. The thickness of the liquid film, which is ejected from the collision surface 309 to the space in the mixer 304, increases as the velocity of the liquid film decreases. The velocity of the liquid film decreases as the distance moved by the liquid film increases. Therefore, as the spread angle of the liquid film at the collision surface 309 increases, the thickness of the liquid film increases and the diameter of particles generated due to breaking of the liquid film increases. If the particles have a large diameter, the efficiency of the mixer 304 in transferring momentum is not increased and the performance of the ejector is not increased. That is, for an ejector including an atomization mechanism, generating a thin liquid film is a key factor in improving the performance.

According to a first aspect of the present disclosure, an ejector includes:

a first nozzle to which a working fluid in a liquid phase is supplied;

a second nozzle into which a working fluid in a vapor phase is sucked;

an atomization mechanism that is disposed at an end of the first nozzle and that atomizes the working fluid in the liquid phase while maintaining the liquid phase; and a mixing space in which the atomized working fluid in the liquid phase generated in the atomization mechanism and the working fluid in the vapor phase sucked into the second nozzle are mixed to generate a merged fluid flow, wherein the atomization mechanism includes:

an orifice; and a collision plate that is disposed on an extended line of a center axial line of the orifice, wherein the collision plate has a collision surface that is inclined with respect to the center axial line of the orifice, and when the collision plate is orthographically projected onto a projection plane, at least one point on a contour of the collision surface is disposed closer to a reference point than a second reference line in a projection of the collision plate, where the reference point is an intersection of the extended line of the center axial line of the orifice with the collision surface, a reference plane is a plane that includes the center axial line of the orifice and that perpendicularly intersects with the collision surface, a collision end point is an intersection of the reference plane with the contour of the collision surface, a first reference line is a line segment that connects the reference point with the collision end point, the second reference line is a line that includes the collision end point and that is perpendicular to the first reference line, and the projection plane is a plane that includes the first reference line and that is perpendicular to the reference plane.

With the first aspect, a thin liquid film can be formed, because decrease in the velocity of a liquid film on the collision surface is suppressed. The thin liquid film breaks into particles having small diameters. Thus, the efficiency in transfer of momentum is increased, and the performance of the ejector is also improved.

According to a second aspect of the present disclosure, for example, in the projection of the collision plate of the ejector according to the first aspect, a distance from the contour of the collision surface to the second reference line increases continuously or stepwise with increasing distance from the collision end point. With the second aspect, even when the capacity and the pressure ratio required for the ejector are both low, the performance of the ejector can be improved.

According to a third aspect of the present disclosure, for example, in the projection of the collision plate of the ejector according to the first or second aspect, a maximum distance from the contour of the collision surface to the second reference line is less than or equal to a length of the first reference line. With the second aspect, even when the capacity required for the ejector is low and the pressure ratio required for the ejector is high, the performance of the ejector can be improved.

According to a fourth aspect of the present disclosure, an ejector includes:

a first nozzle to which a working fluid in a liquid phase is supplied;

a second nozzle into which a working fluid in a vapor phase is sucked;

an atomization mechanism that is disposed at an end of the first nozzle and that atomizes the working fluid in the liquid phase while maintaining the liquid phase; and a mixing space in which the atomized working fluid in the liquid phase generated in the atomization mechanism and the working fluid in the vapor phase sucked into the second nozzle are mixed to generate a merged fluid flow, wherein the atomization mechanism includes:

an orifice; and a collision plate that is disposed on an extended line of a center axial line of the orifice, wherein the collision plate has a collision surface that is inclined with respect to the center axial line of the orifice, and the ejector satisfies at least one of the following conditions: (a) a position of a point on a contour of the collision surface changes in a direction parallel to a center axial line of the ejector; and (b) the contour of the collision surface includes a portion that is convex toward an outlet of the ejector.

According to a fifth aspect of the present disclosure, for example, in the ejector according to the fourth aspect, a distance from the contour of the collision surface to a second reference plane increases continuously or stepwise with increasing distance from a collision end point, where a reference point is an intersection of the extended line of the center axial line of the orifice with the collision surface, a first reference plane is a plane that includes the center axial line of the orifice and that perpendicularly intersects with the collision surface, the collision end point is an intersection of the first reference plane with the contour of the collision surface, and the second reference plane is a plane that includes the collision end point and that is perpendicular to the center axial line of the ejector.

According to a sixth aspect of the present disclosure, for example, in the ejector according to the fifth aspect, a maximum distance from the contour of the collision surface to the second reference plane is less than or equal to a distance from the reference point to the second reference plane.

With the fourth to sixth aspects, the same advantages as the first to third aspects are obtained.

According to a seventh aspect of the present disclosure, a heat pump apparatus includes:

a compressor that compresses a refrigerant vapor;

a heat exchanger through which a refrigerant liquid flows;

the ejector according to any one of Claims 1 to 6, the ejector generating a merged refrigerant flow by using the refrigerant vapor compressed by the compressor and the refrigerant liquid flowing from the heat exchanger;

an extractor that receives the merged refrigerant flow from the ejector and that extracts the refrigerant liquid from the merged refrigerant flow;

a liquid path that extends from the extractor to the ejector via the heat exchanger; and an evaporator that stores the refrigerant liquid and that generates the refrigerant vapor, which is to be compressed by the compressor, by evaporating the refrigerant liquid.

With the seventh aspect, the refrigerant liquid supplied to the ejector is used as a drive flow, and the refrigerant vapor from the compressor is sucked into the ejector. The ejector generates the merged refrigerant flow by using the refrigerant liquid and the refrigerant vapor. Because the work to be done by the compressor can be reduced, the heat pump apparatus can have an efficiency that is higher than or equal to those of existing compressors while considerably reducing the pressure ratio of the compressor. Moreover, the heat pump apparatus can be reduced in size.

According to an eighth aspect of the present disclosure, for example, in the heat pump apparatus according to the seventh aspect, a pressure of the merged refrigerant flow discharged from the ejector is higher than a pressure of the refrigerant vapor sucked into the ejector and lower than a pressure of the refrigerant liquid supplied to the ejector. With the eighth aspect, the pressure of the refrigerant can be increased efficiently.

According to a ninth aspect of the present disclosure, for example, in the heat pump apparatus according to the seventh or eighth aspect, the refrigerant is a refrigerant whose saturated vapor pressure at room temperature is a negative pressure.

According to a tenth aspect of the present disclosure, for example, in the heat pump apparatus according to any one of the seventh to ninth aspects, the refrigerant includes water as a main component. The environmental load of a refrigerant including water as a main component is low.

Hereinafter, embodiments of the present disclosure will be described with reference to the drawings. Note that the present disclosure is not limited to the embodiments described below.

As illustrated in FIG. 1, an ejector 11 includes a first nozzle 40, a second nozzle 41, a mixer 42, a diffuser 43, and an atomization mechanism 44. The diffuser 43 may be omitted. The first nozzle 40 is a tubular portion disposed at a central part of the ejector 11. A refrigerant liquid (a working fluid in a liquid phase) is supplied to the first nozzle 40 as a drive flow. The second nozzle 41 forms a ring-shaped space around the first nozzle 40. A refrigerant vapor (a working fluid in a vapor phase) is sucked into the second nozzle 41. The mixer 42 is a tubular portion connected to both of the first nozzle 40 and the second nozzle 41. The mixer 42 has an inner space, which corresponds to a mixing space. The atomization mechanism 44 is disposed at an end of the first nozzle 40 so as to face the mixer 42. The atomization mechanism 44 has a function of atomizing the refrigerant liquid while maintaining the liquid phase. The atomized refrigerant generated by the atomization mechanism 44 and the refrigerant vapor sucked into the second nozzle 41 are mixed in the mixer 42, and thereby a merged refrigerant flow (merged fluid flow) is generated. The diffuser 43 is a tubular portion that is connected to the mixer 42 and that has an opening through which the merged refrigerant flow is discharged to the outside of the ejector 11. The inside diameter of the diffuser 43 gradually increases from the upstream side to the downstream side. The velocity of the merged refrigerant flow s reduced in the diffuser 43, and thereby the static pressure of the merged refrigerant flow recovers. If the diffuser 43 is omitted, the static pressure of the merged refrigerant flow recovers in the mixer 42. The first nozzle 40, the second nozzle 41, the mixer 42, the diffuser 43, and the atomization mechanism 44 have a common center axial line O.

Figure 2A:
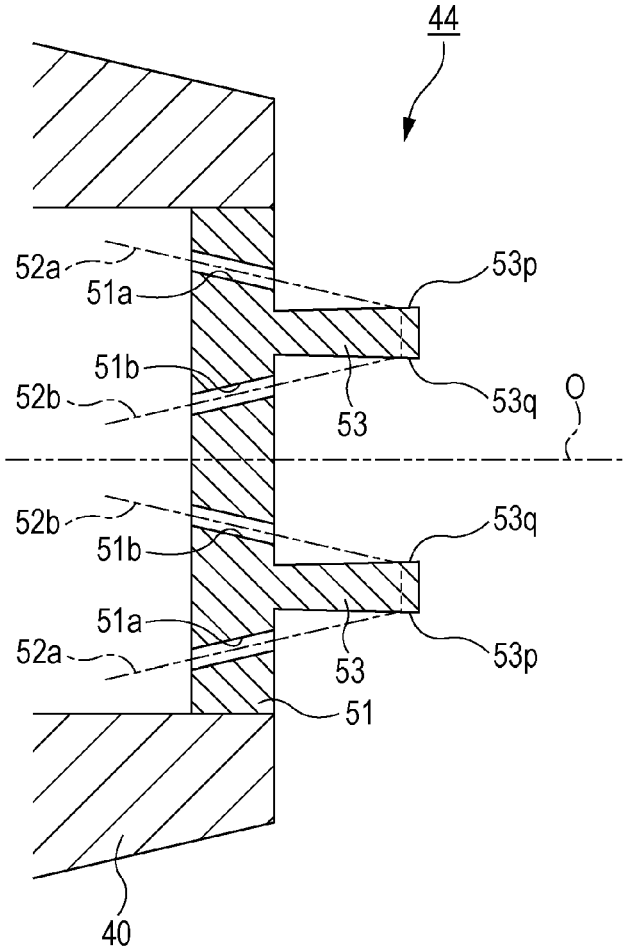
FIG. 2A is a partial enlarged sectional view of an atomization mechanism of the ejector illustrated in FIG. 1.
Figure 2B:
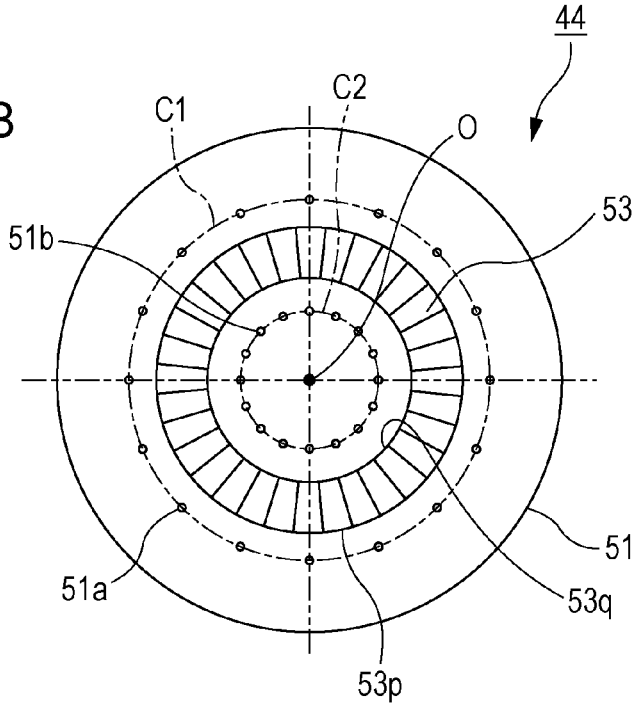
FIG. 2B is a plan view of the atomization mechanism of the ejector illustrated in FIG. 1.

As illustrated in FIGS. 2A and 2B, the atomization mechanism 44 includes an ejection section 51 and a collision plate 53 (collision surface forming section). The ejection section 51 is attached to the end of the first nozzle 40. The ejection section 51 has a plurality of first orifices 51*a* and a plurality of second orifices 51*b* (ejection holes). The first and second orifices 51*a* and 51*b* extend through the ejection section 51 so as to connect the first nozzle 40 to the mixer 42. The collision plate 53 is disposed on extension lines of center axial lines 52*a* and 52*b* of the first and second orifices 51*a* and 51*b*. Through the first and second orifices 51*a* and 51*b*, the refrigerant liquid is ejected from the first nozzle 40 toward the collision plate 53. In other words, the ejection section 51 can generate a plurality of jets of the refrigerant liquid. Each of the jets ejected from the first and second orifices 51*a* and 51*b* collides with the collision plate 53. Thus, a microspray flow is generated.

The collision plate 53 has a first main surface 53*p* and a second main surface 53*q*, which are collision surfaces with which the jets ejected from the ejection section 51 collide. The first main surface 53*p* and the second main surface 53*q* extend toward the outlet of the ejector 11. The first orifices 51*a* are disposed adjacent to the first main surface 53*p* of the collision plate 53. The second orifices 51*b* are disposed adjacent to the second main surface 53*q* of the collision plate 53. Jets that are ejected from the first orifices 51*a* collide with the first main surface 53*p* of the collision plate 53. Jets that are ejected from the second orifices 51*b* collide with the second main surface 53*q* of the collision plate 53. Thus, the atomization mechanism 44 is structured so that the jets collide with both surfaces of the collision plate 53. The term "main surface" refers to a surface of the collision plate 53 having the largest area.

As in the present embodiment, when the jets of refrigerant liquid collide with both surfaces of the collision plate 53, films of the jets are formed on both surfaces of the collision plate 53. Accordingly, even when dripping of the liquid occurs on one of the surfaces, the dripping liquid is merged into a film of the jets on the other surface and atomized. That is, with the atomization mechanism 44 according to the present embodiment, it is possible to generate a spray flow efficiently while suppressing occurrence of dripping of liquid.

As illustrated in FIG. 2A, in the present embodiment, the collision plate 53 is tubular and protrudes from a surface of the ejection section 51 toward the outlet of the ejector 11. The first main surface 53*p* and the second main surface 53*q* are annular surfaces. To be specific, the first main surface 53*p* is formed so that the distance from the center axial line O to the first main surface 53*p* increases with decreasing distance from the outlet of the ejector 11. The second main surface 53*q* is formed so that the distance from the center axial line O to the second main surface 53*q* decreases with decreasing distance from the outlet of the ejector 11. Having such a shape, the collision plate 53 can uniformly supply a spray flow toward the mixer 42.

As illustrated in FIG. 2A, the center axial lines 52*a* of the first orifices 51*a* are inclined with respect to the first main surface 53*p* of the collision plate 53 and intersect with the collision plate 53. The center axial lines 52*b* of the second orifices 51*b* are inclined with respect to the second main surface 53*q* of the collision plate 53 and intersect with the collision plate 53. The center axial lines 52*a* of the first orifices 51*a* and the center axial lines 52*b* of the second orifices 51*b* may be inclined with respect to an inner wall 42*p* of the mixer 42. The shapes (cross-sectional shapes) of the openings of the first and second orifices 51*a* and 51*b* are not particularly limited. For example, the shapes of the openings of the first and second orifices 51*a* and 51*b* may be circular, elliptical, or rectangular. By appropriately determining the shapes, the number, and the arrangement of the first and second orifices 51*a* and 51*b*, it is possible to make the size of liquid droplets in a spray flow be uniform.

As illustrated in FIG. 2B, the first orifices 51*a* are arranged at equal distances along the first main surface 53*p* of the collision plate 53. That is, the first orifices 51*a* are arranged on a first imaginary circle C1. Likewise, the second orifices 51*b* are arranged at equal distances along the second main surface 53*q* of the collision plate 53. That is, the second orifices 51*b* are arranged on a second imaginary circle C2, which is concentric with the first imaginary circle C1. The first orifices 51*a* and the second orifices 51*b* are arranged in pairs that are disposed at equal angular positions around the center axial line O. The first main surface 53*p*, which is annular, is concentric with the first imaginary circle C1 and the second imaginary circle C2. The second main surface 53*q*, which is annular, is concentric with the first imaginary circle C1 and the second imaginary circle C2. With such arrangement, dripping of the refrigerant liquid due to flowing of the refrigerant liquid between the two main surfaces is sufficiently suppressed. The first orifices 51*a* are arranged axially symmetrically, and the second orifices 51*b* are arranged axially symmetrically. Therefore, variation in the diameter of liquid droplets in the spray flow is reduced. The number of the first orifices 51*a* may be equal to or different from the number of the second orifices 51*b*.

Figure 3:
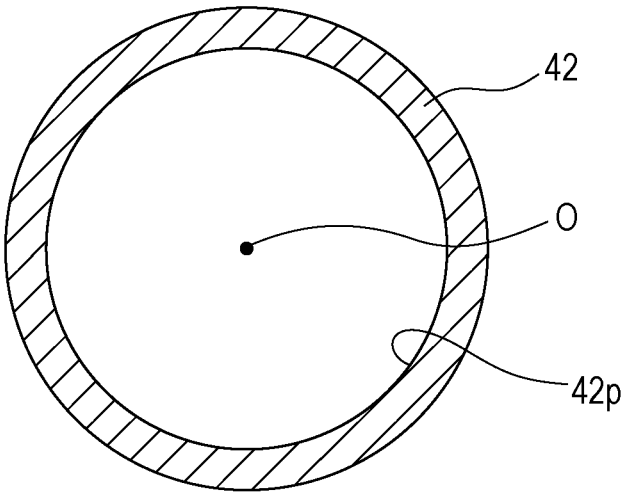
FIG. 3 is sectional view of a mixer of the ejector illustrated in FIG. 1, taken along line III-III of FIG. 1.

As illustrated in FIG. 3, in a cross section perpendicular to the center axial line O of the ejector 11, the inner wall 42*p* of the mixer 42 is circular. In the present embodiment, the first main surface 53*p* and the second main surface 53*q*, each of which corresponds to a collision surface, are annular surfaces. Accordingly, the spray flow spreads in an annular shape in the mixer 42. It is possible to improve the volumetric efficiency of the ejector 11, because the cross-sectional shape of the mixer 42 is similar to the shape in which the first and second orifices 51*a* and 51*b* are arranged in the atomization mechanism 44, that is, the cross-sectional shape of the mixer 42 is similar to the spreading shape of the spray flow.

In the present embodiment, the mixer 42 includes a portion in which the cross-sectional area (inside diameter) gradually decreases and a portion in which the cross-sectional area (inside diameter) is uniform. However, the mixer 42 may have only the portion in which the cross-sectional area gradually decreases.

With the ejector 11, a drive flow in a liquid phase, which is input to the first nozzle 40, and a suction flow in a vapor phase, which is input to the second nozzle 41, are mixed together in the mixer 42 (mixing space), thereby generating a merged refrigerant flow. The atomization mechanism 44 changes the drive flow in the liquid phase, which is input to the first nozzle 40, into a microspray flow; and the microspray flow flows into the mixer 42. In the process of generating the merged refrigerant flow, the pressure of the refrigerant merged fluid flow is increased as the momentum of the drive flow in the liquid phase is transferred to the suction flow in the vapor phase, and the temperature of the merged refrigerant flow rises as the suction flow becomes condensed. The atomization mechanism 44 uses a single-fluid atomization method. To be specific, the atomization mechanism 44 forms jets, each having a columnar shape, by ejecting the drive flow in the liquid phase from the first and second orifices 51*a* and 51*b*. The jets, each having a columnar shape, collide with the collision plate 53 and form a liquid film. The liquid film is ejected to a space from an end of the collision plate 53, and the liquid film is changed into fine particles.

Figure 4A:
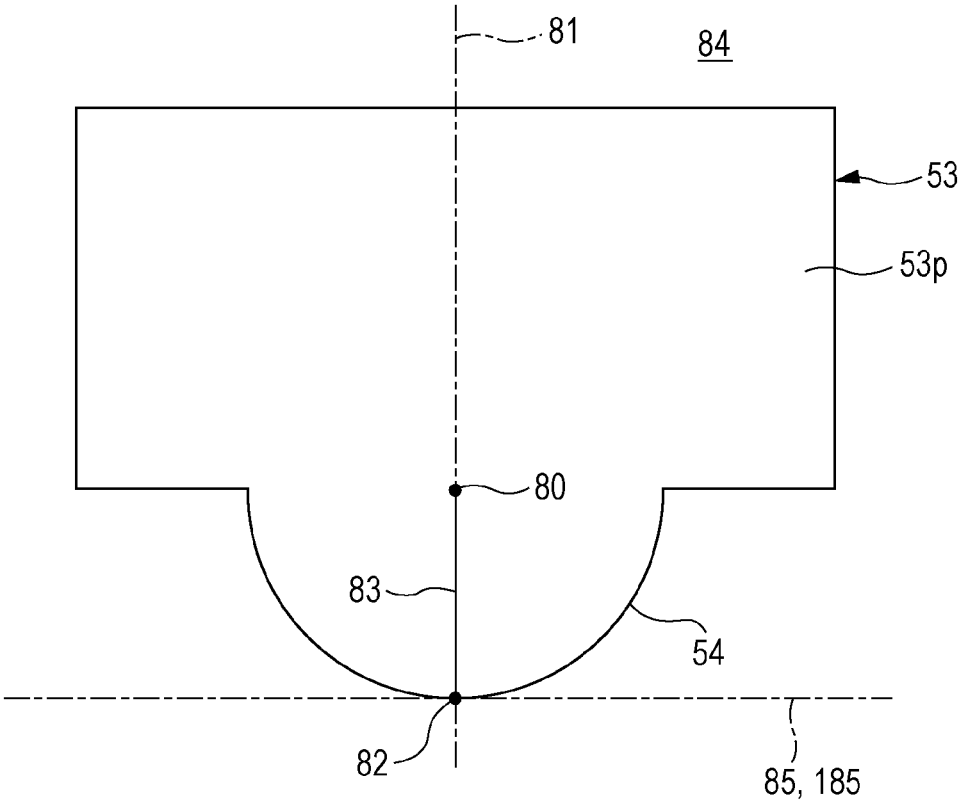
FIG. 4A is a partial projection view obtained by projecting a part of a collision plate of the atomization mechanism onto a projection plane parallel to the center axial line of the ejector.
Figure 4B:
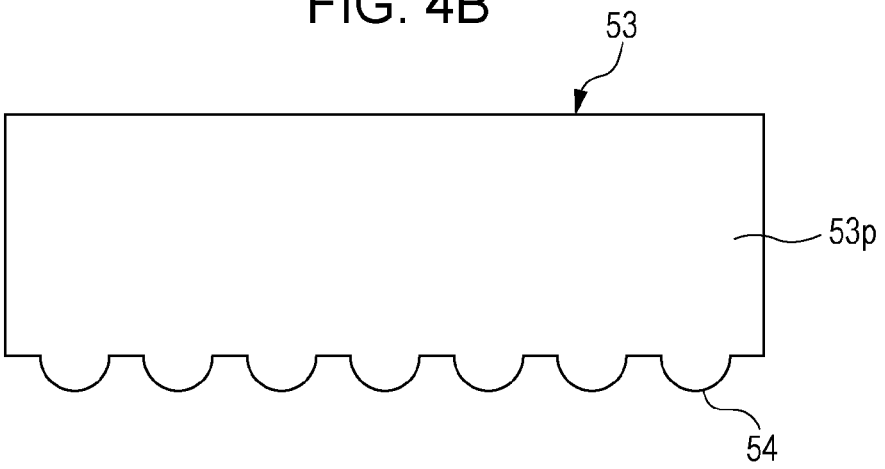
FIG. 4B is a developed view of the collision plate.

As described above, in order to improve the performance of the ejector 11, it is important that a thin liquid film be formed at the collision surface (the first main surface 53*p* and the second main surface 53*q*) and that fine particles (liquid droplets) be formed due to breaking of the thin liquid film. In order to form a thin liquid film having a uniform thickness, the atomization mechanism 44 of the ejector 11 according to the present embodiment has a structure that will be described below with reference to FIGS. 4A and 4B. FIG. 4A is a partial projection view obtained by projecting a part of the collision plate 53 onto a projection plane parallel to the center axial line O of the ejector 11. FIG. 4B is a developed view of the collision plate 53.

As illustrated in FIGS. 4A and 4B, a reference point 80 is the intersection of the center axial line 52*a* of the first orifice 51*a* (see FIG. 2A) with the first main surface 53*p* (collision surface). A reference plane 81 is a plane that includes the center axial line 52*a* of the first orifice 51*a* (the center axial line of a jet) and that perpendicularly intersects with the first main surface 53*p*. A collision end point 82 is the intersection of the reference plane 81 with a contour 54 of the first main surface 53*p* on the outlet side of the ejector 11. A first reference line 83 is a line segment that connects the reference point 80 with the collision end point 82. A projection plane 84 is a plane that includes the first reference line 83 and that is perpendicular to the reference plane 81. In FIG. 4A, The reference plane 81 is perpendicular to the plane of FIG. 4A. When the collision plate 53 is orthographically projected onto the projection plane 84, in the projection of the collision plate 53, at least one point on the contour 54 of the first main surface 53*p* is disposed closer to the reference point 80 than a second reference line 85, which is a line that includes the collision end point 82 and which is perpendicular to the first reference line 83. In the present embodiment, in the projection of the collision plate 53, the entirety of the contour 54 of the first main surface 53*p* is disposed closer to the reference point 80 than the second reference line 85.

In other words, in the present embodiment, the position of a point on the contour 54 of the first main surface 53*p* on the outlet side of the ejector 11 changes in the direction parallel to the center axial line O of the ejector 11. In still other words, the contour 54 of the first main surface 53*p* includes a portion that is convex toward the outlet of the ejector 11. The convex portion is located at a position (angular position) where a jet from the first orifice 51*a* collides with the first main surface 53*p*. The position (angular position) of the convex portion around the center axial line O is the same as that of the position (angular position) of the first orifice 51*a*. With such a structure, the following advantages can be obtained.

Figure 5A:
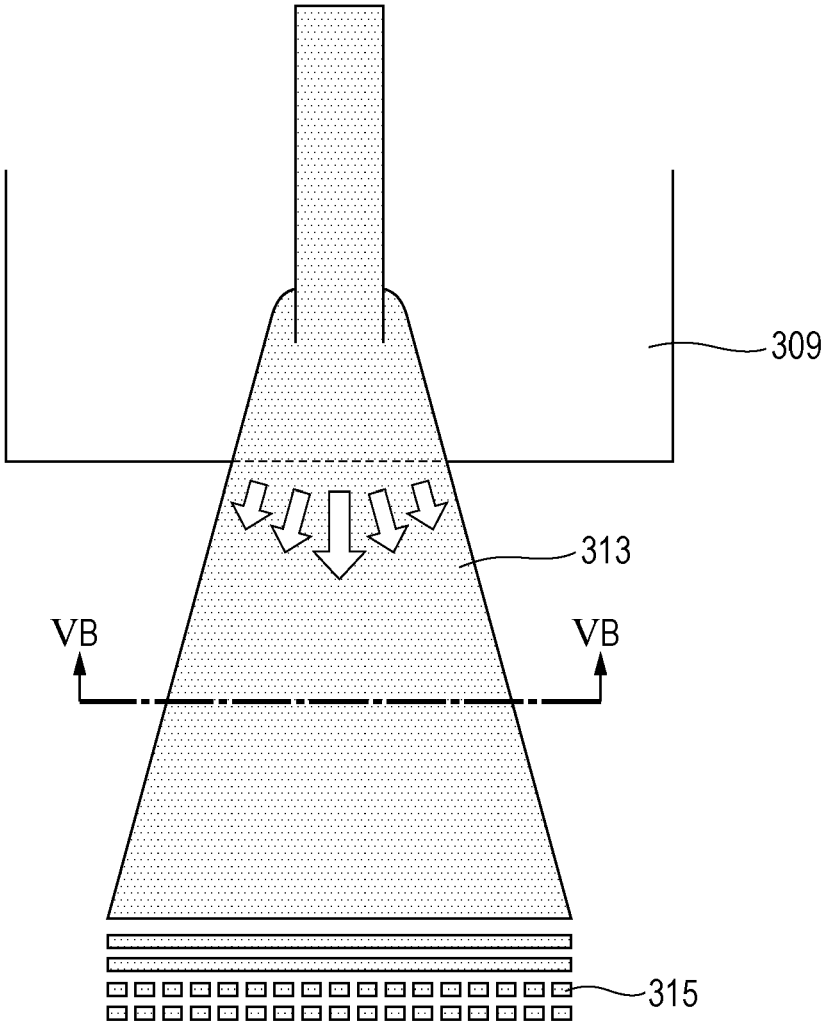
FIG. 5A illustrates the function of an ejector described in International Publication No. 2015/019563.
Figure 5B:
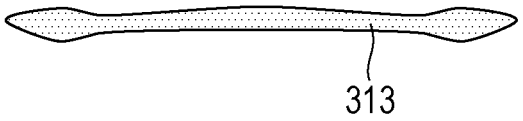
FIG. 5B is a sectional view of a liquid film generated by the ejector described in International Publication No. 2015/019563, taken along line VB-VB of FIG. 5A.
Figure 12:
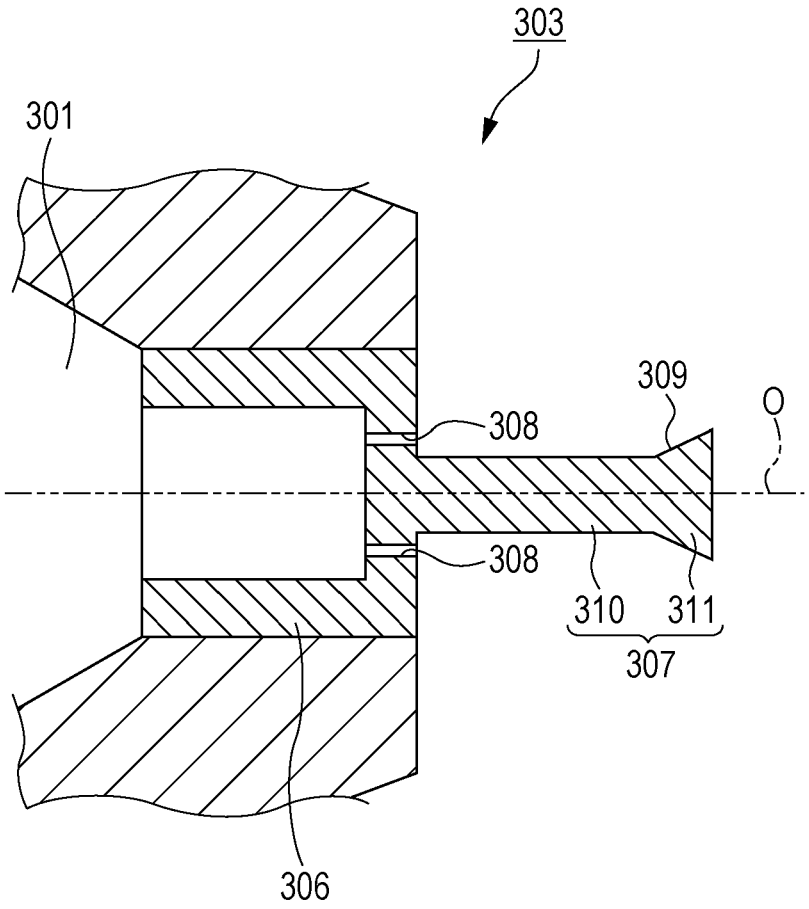
FIG. 12 is an enlarged sectional view of an atomization mechanism of the ejector illustrated in FIG. 11.

Referring to FIGS. 5A and 12, the atomization mechanism 303 of the ejector 300 described in International Publication No. 2015/019563 will be described. Jets from the orifices 308 collide with the collision surface 309. As the jets spread radially, a thin liquid film 313 is formed. The thin liquid film 313 ejected from the collision surface 309 breaks into fine particles 315 due to the instability phenomenon of the liquid film itself. The thinner the liquid film 313 and the greater the velocity of the liquid film 313, the smaller the particles into which the liquid film 313 breaks. However, due to development of a boundary layer, the thin liquid film 313 decelerates and becomes thicker while flowing along the collision surface 309. Because the position of a point on the contour of the collision surface 309 on the outlet side of the ejector 300 does not change (is fixed) in the direction parallel to the center axial line of the ejector 300, the distance that both end portions of the liquid film 313 move on the collision surface 309 is greater than the distance that a central part of the liquid film 313 moves on the collision surface 309. As a result, as illustrated in FIG. 5B, the thicknesses of both end portions of the liquid film 313 in the width direction are greater than the thickness of the central part of the liquid film 313, and the diameter of the particles 315 are also increased.

Figure 6A:
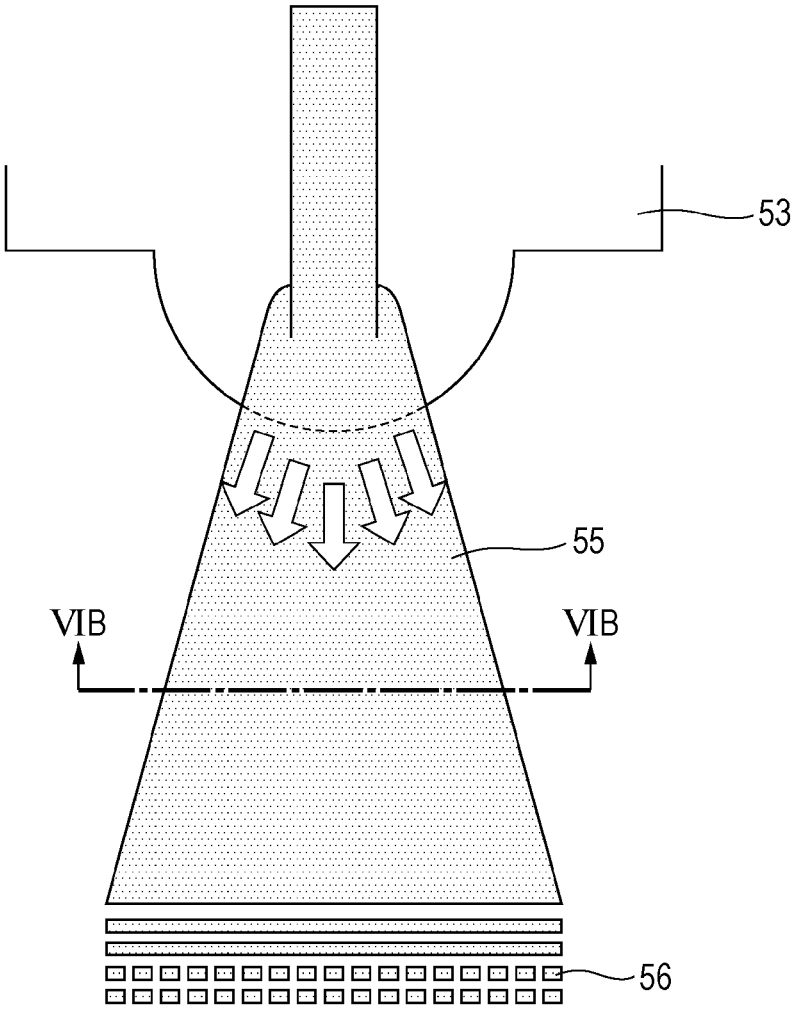
FIG. 6A illustrates the function of the ejector according to the embodiment.
Figure 6B:
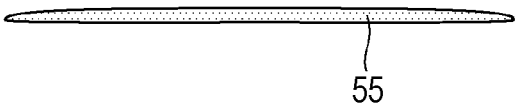
FIG. 6B is a sectional view of a liquid film generated by the ejector according to the embodiment, taken along line VIB-VIB of FIG. 6A.

As illustrated in FIG. 6A, according to the present embodiment, at least one point on the contour 54 of the first main surface 53*p* is located closer to the reference point 80 than the second reference line 85 (see FIG. 4A). Therefore, the distance that both end portions of a liquid film 55 move on the first main surface 53*p* is substantially the same as the distance that a central part of the liquid film 55 moves on the first main surface 53*p*, and deceleration of both end portions of the liquid film 55 is suppressed. As illustrated in FIG. 6B, a uniform and thin liquid film 55 is formed. The liquid film 55 is ejected to a space (the mixer 42) and breaks into particles 56 having small diameters. As a result, transfer of momentum between a refrigerant in a vapor phase and a refrigerant in a liquid phase (particles of the refrigerant in the liquid phase) is performed efficiently, and the performance of the ejector 11 is also improved. With the present embodiment, if a sufficiently high performance (pressure ratio and efficiency) has been achieved, it is possible to decrease the size of the ejector.

It is necessary to reduce the flow rate of a drive flow if one or both of the following conditions are satisfied: the capacity required for the ejector is low; and the pressure ratio required for the ejector is low. In this case, the velocity of jets from the orifices decreases, and the flow rate of the liquid film decreases. If the velocity of jets is low and the flow rate of the liquid film is low, the velocity of both end portions, in the width direction, of the liquid film decreases considerably and the diameter of particles formed from the liquid film tend to increase. The term "capacity required for the ejector" means the flow rate of vapor whose pressure is to be increased. The "pressure ratio required for the ejector" is the ratio of the static pressure at the outlet of the ejector to the total pressure at the inlet of the ejector, which means the saturation pressure if the fluid at the outlet is a two-phase flow.

As illustrated in FIG. 4A, according to the present embodiment, in the projection of the collision plate 53, the distance from the contour 54 of the first main surface 53*p* to the second reference line 85 continuously increases with increasing distance from the collision end point 82. With such a structure, even when the flow rate of the liquid film 55 is low, deceleration of the liquid film 55 is suppressed, and a sufficiently thin liquid film 55 is formed. Therefore, the diameter of the particles 56, which are formed due to breaking of the liquid film 55, is sufficiently small. A second reference plane 185 may be defined as a plane that includes the collision end point 82 and that is perpendicular to the center axial line O of the ejector 11. In this case, the distance from the contour 54 of the first main surface 53*p* to the second reference plane 185 continuously increases with increasing distance from the collision end point 82.

Moreover, with the present embodiment, because deceleration of the liquid film 55 is suppressed on the average, the amount of refrigerant liquid that flows to the back side of the collision plate 53 at the end of the collision plate 53 due to surface tension is reduced and therefore dripping of the refrigerant liquid is suppressed.

As illustrated in FIG. 4A, according to the present embodiment, in the projection of the collision plate 53, the maximum distance from the contour 54 of the first main surface 53*p* to the second reference line 85 is less than or equal to the length of the first reference line 83. To be specific, the maximum distance from the contour 54 of the first main surface 53*p* to the second reference line 85 is substantially equal to the length of the first reference line 83. With such a structure, even when the velocity of jets is high and the flow rate of the liquid film is low, deceleration of the liquid film 55 is suppressed and occurrence of a hydraulic jump is prevented. As a result, increase in the thickness of both end portions of the liquid film 55 is suppressed, and the diameter of the particles 56 formed due to breaking of the liquid film 55 is sufficiently small. When the second reference plane 185 is defined as described above, the maximum distance from the contour 54 of the first main surface 53*p* to the second reference plane 185 may be less than or equal to the distance from the reference point 80 to the second reference plane 185. The term "hydraulic jump" refers to a phenomenon that the thickness of a liquid film increases discontinuously after flowing a certain distance.

According to the present embodiment, spaces are formed in portions of the collision plate 53 with which the jets do not collide. In other words, the end of the collision plate 53 has protruding portions and recessed portions that are periodically arranged. In this case, the recessed portions promote diffusion of a gas (refrigerant in a vapor phase) between one surface (the first main surface 53*p*) and the other surface (the second main surface 53*q*) of the collision plate 53. As a result, a change in the spray direction due to nonuniform pressure distribution on the front and back surfaces of the collision plate 53 is suppressed.

Figure 7A:
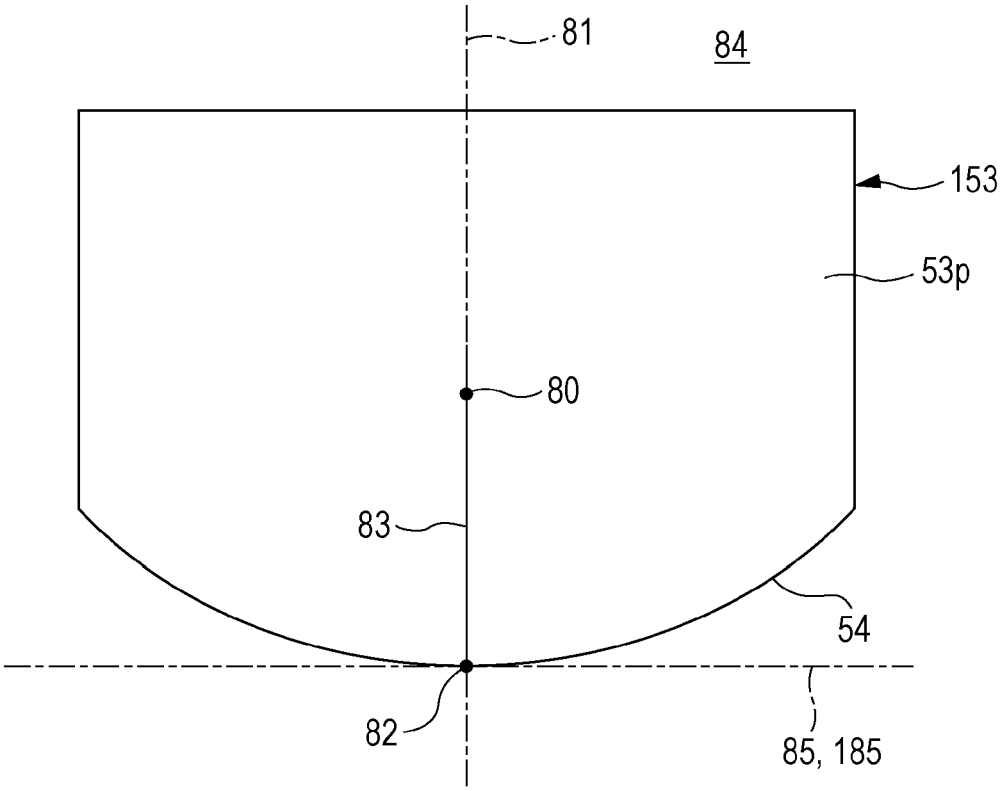
FIG. 7A is a partial projection view obtained by projecting a part of a collision plate according to a modification onto a projection plane parallel to the center axial line of the ejector.
Figure 7B:
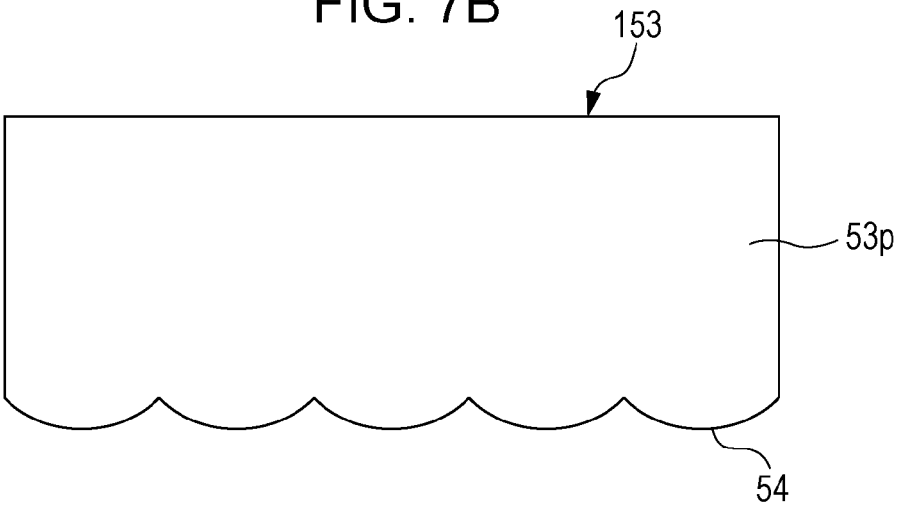
FIG. 7B is a developed view of the collision plate according to the modification.

FIGS. 7A and 7B illustrate a collision plate 153 according to a modification, in which the maximum distance from the contour 54 of the first main surface 53*p* to the second reference line 85 is less than the length of the first reference line 83 in the projection of the collision plate 153. The collision plate 153 according to the modification provides the same advantages as the collision plate 53 shown in FIGS. 4A and 4B. When the second reference plane 185 is defined as described above, the maximum distance from the contour 54 of the first main surface 53*p* to the second reference plane 185 may be less than or equal to the distance from the reference point 80 to the second reference plane 185.

Figure 7C:
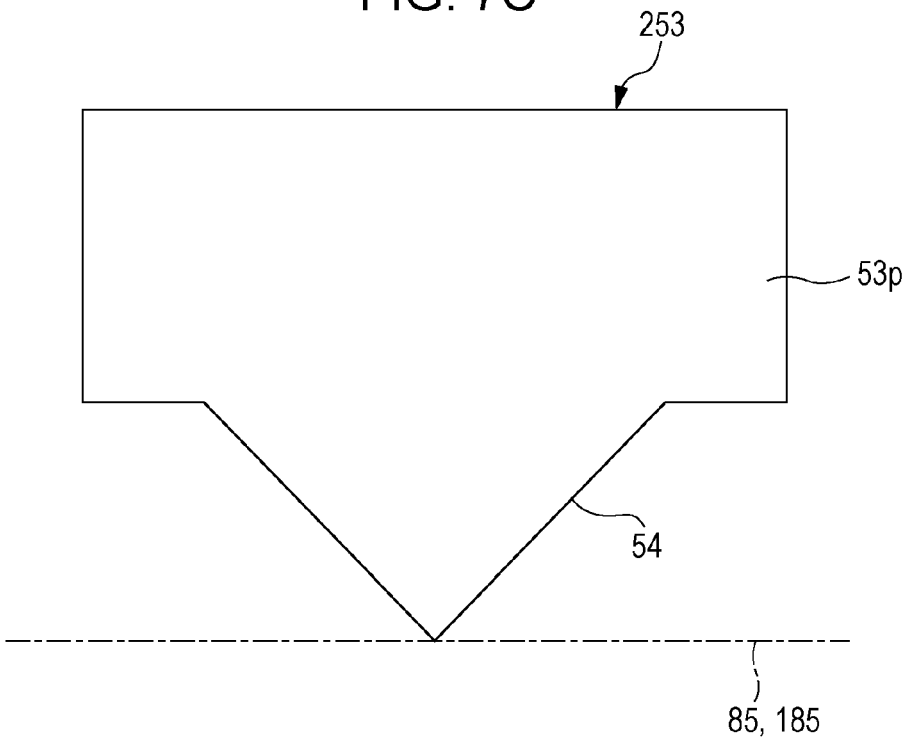
FIG. 7C is a partial projection view obtained by projecting a part of a collision plate according to another modification onto a projection plane parallel to the center axial line of the ejector.

As illustrated in FIGS. 4A and 4B, according to the present embodiment, the contour 54 of the first main surface 53*p* includes a combination of curves and straight lines. However, as in the collision plate 153 shown in FIGS. 7A and 7B, the contour 54 of the first main surface 53*p* may include only curves. As in a collision plate 253 shown in FIG. 7C, the contour 54 of the first main surface 53*p* may include only straight lines. Each of the collision plates 153 and 253 shown in FIGS. 7A and 7C provides the same advantages as the collision plate 53 described above with reference to FIGS. 4A and 4B.

Figure 7D:
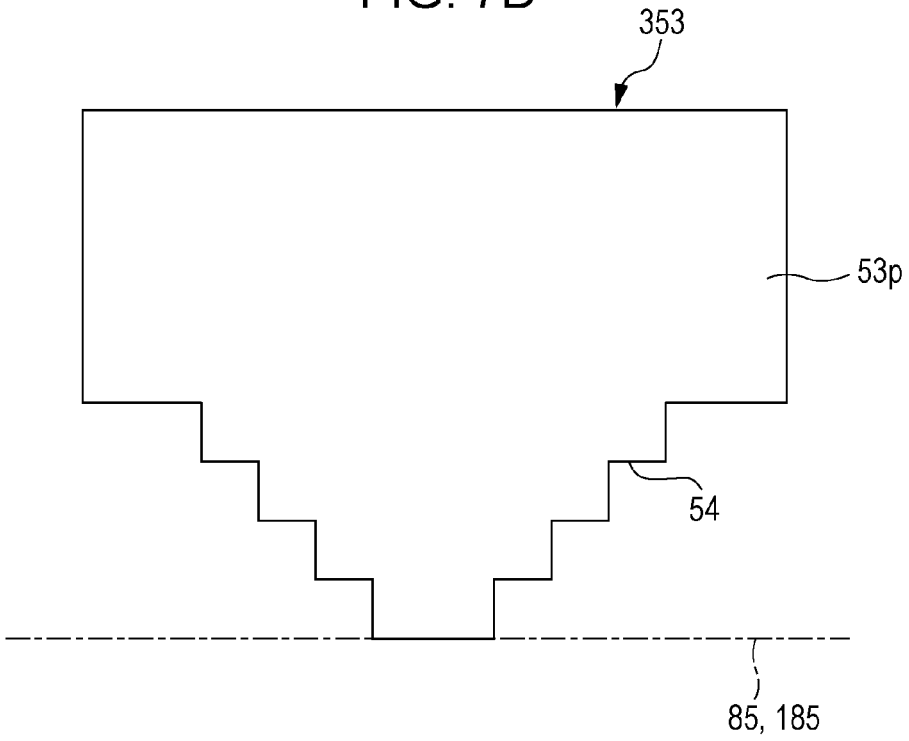
FIG. 7D is a partial projection view obtained by projecting a part of a collision plate according to still another modification onto a projection plane parallel to the center axial line of the ejector.

FIG. 7D illustrates a collision plate 353 in which the distance from the contour 54 of the first main surface 53*p* to the second reference line 85 (the second reference plane 185) increases stepwise with increasing distance from the collision end point 82. The collision plate 353 shown in FIG. 7D provides the same advantages as the collision plate 53 described above with reference to FIGS. 4A and 4B.

The second orifices 51*b* and the second main surface 53*q* may also have structures that are the same as those described above with reference to FIGS. 4A to 7D. Only the second orifices 51*b* and the second main surface 53*q* may have the structures described above with reference to FIGS. 4A to 7D.

In each of the embodiment and the modifications, the collision plates 53, 153, 253, and 353 are tubular. However, the shape of a collision plate suitable for the atomization mechanism 44 is not limited to a tubular shape. For example, a flat collision plate may be used for the atomization mechanism 44 of the ejector 11.

The collision plate 53 may have only the first orifices 51*a* facing the first main surface 53*p* or only the second orifices 51*b* facing the second main surface 53*q*.

Heat Pump Apparatus Including Ejector According to Embodiment

Figure 8:
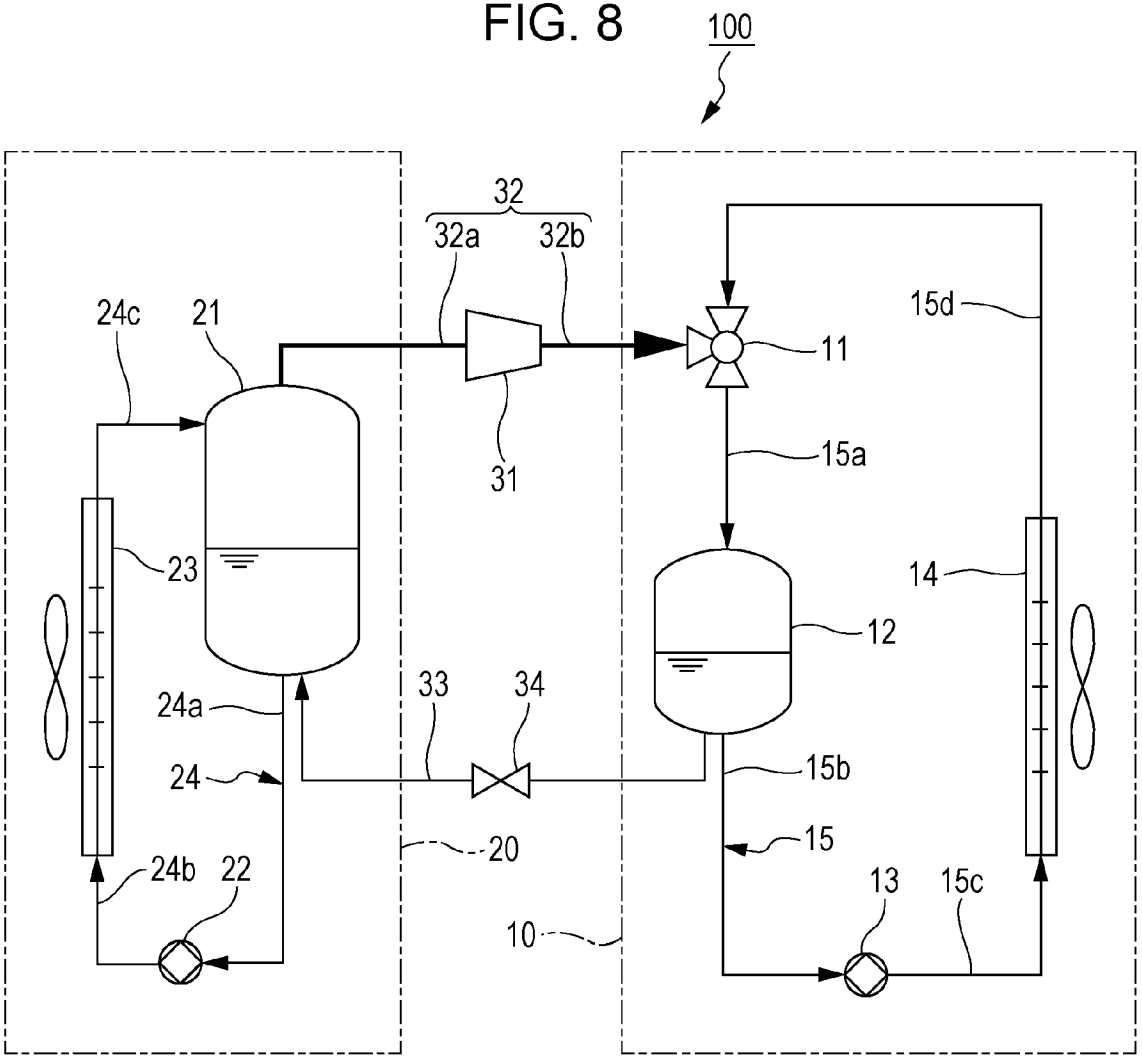
FIG. 8 is a block diagram of a heat pump apparatus including the ejector.
Figure 9:
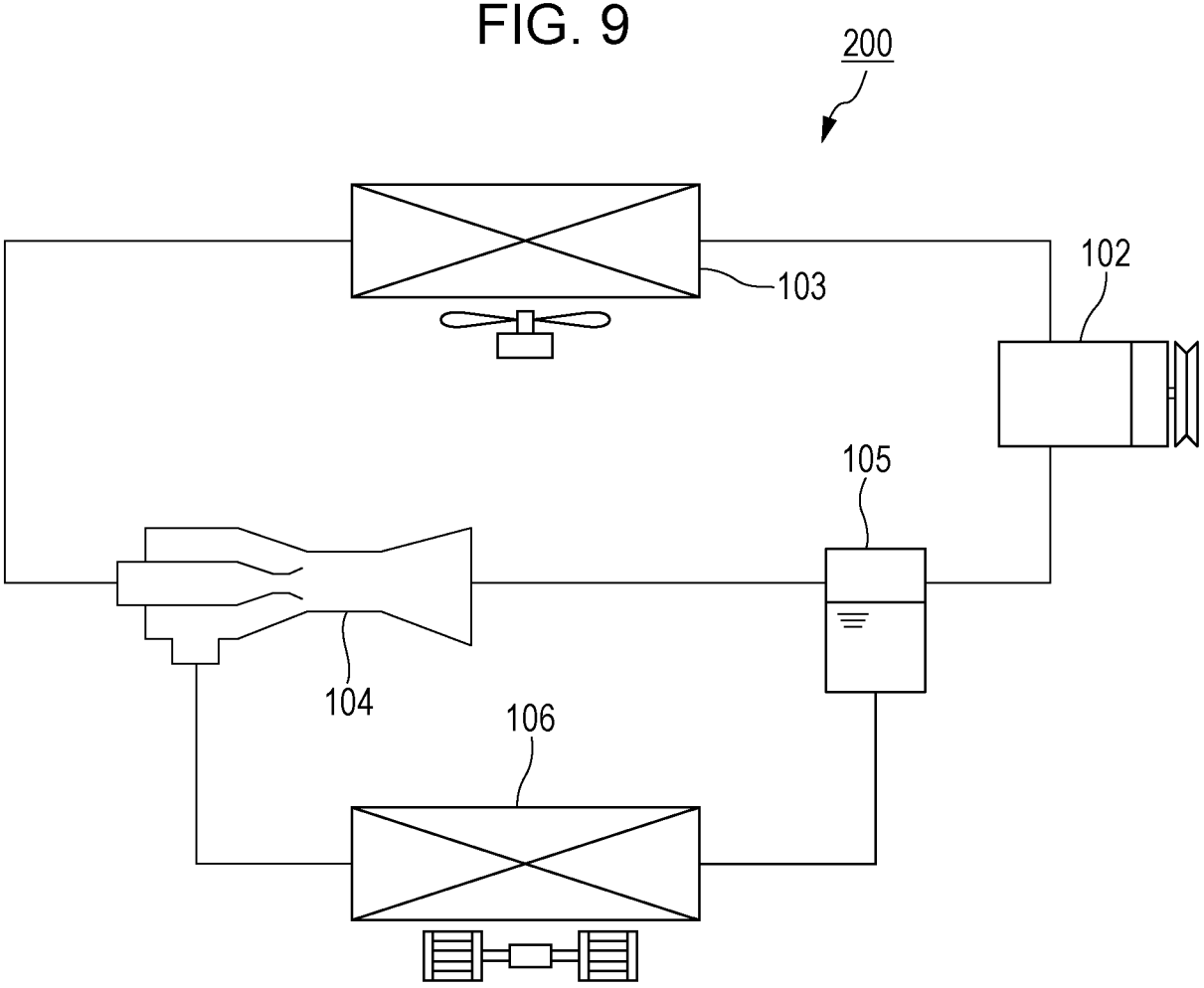
FIG. 9 is a block diagram of an existing refrigeration cycle apparatus.
Figure 10:
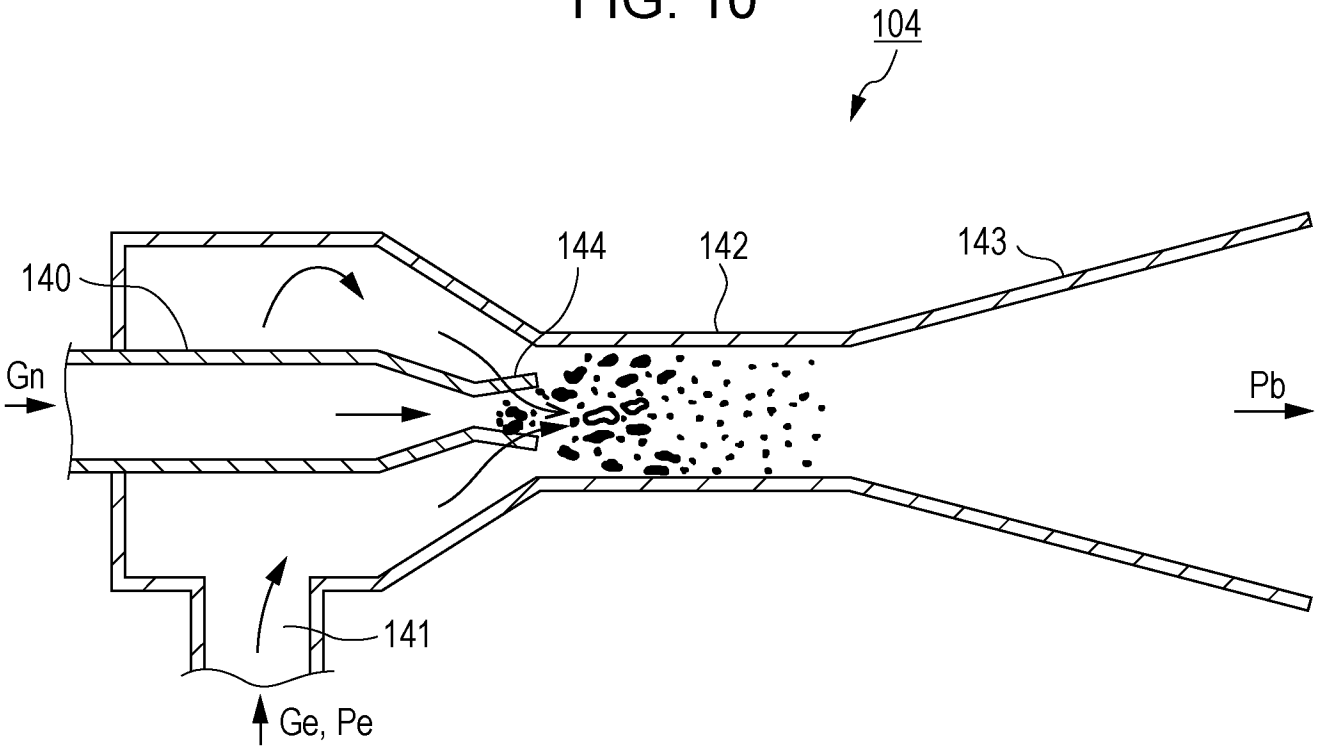
FIG. 10 is a sectional view of an ejector of the refrigeration cycle apparatus illustrated in FIG. 9.
Figure 11:
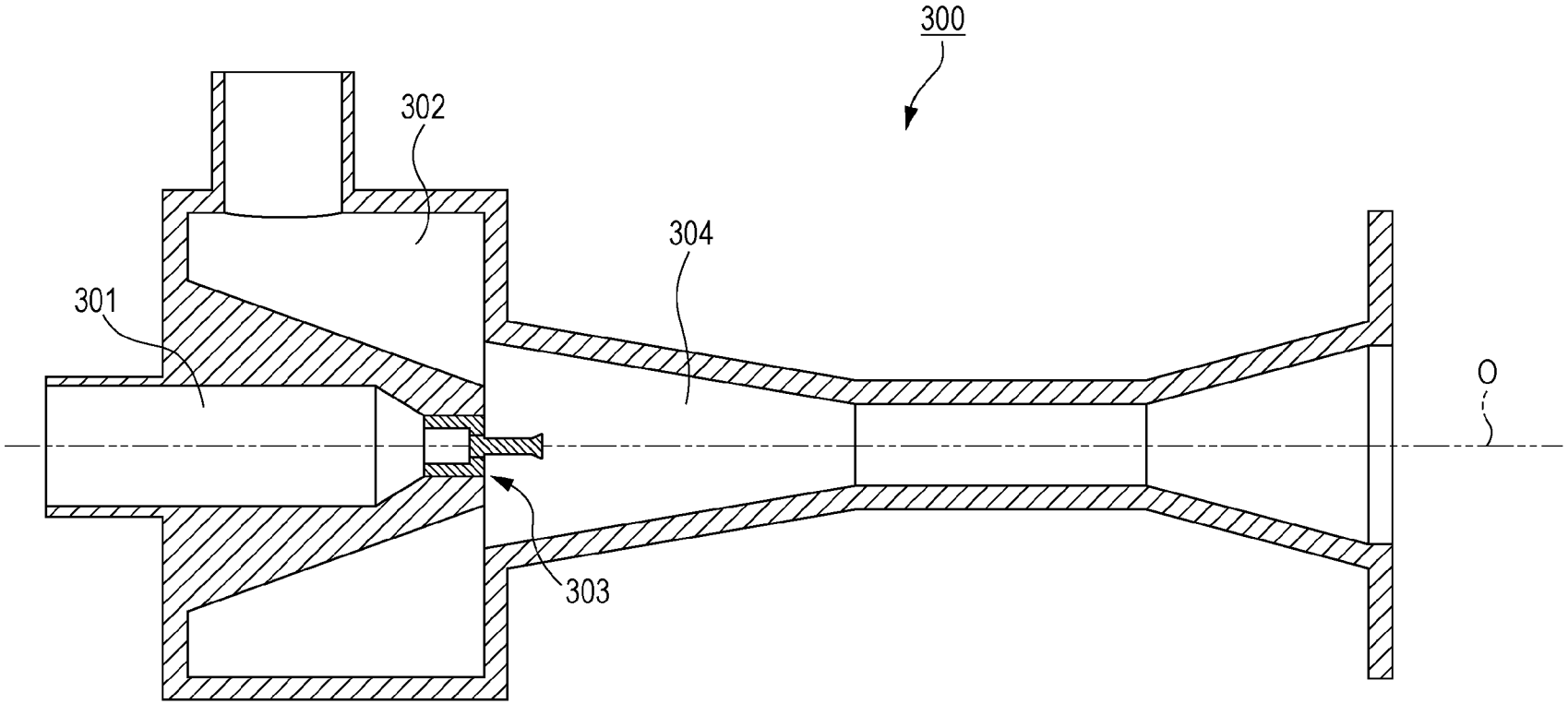
FIG. 11 is a sectional view of the ejector described in International Publication No. 2015/019563.

As illustrated in FIG. 8, a heat pump apparatus 100 (refrigeration cycle apparatus) according to the present embodiment includes a first heat exchange unit 10, a second heat exchange unit 20, a compressor 31, and a vapor path 32. The first heat exchange unit 10 and the second heat exchange unit 20 are respectively a heat releasing circuit and a heat absorbing circuit. A refrigerant vapor generated by the second heat exchange unit 20 is supplied to the first heat exchange unit 10 via the compressor 31 and the vapor path 32.

The heat pump apparatus 100 is filled with a refrigerant whose saturated vapor pressure is a negative pressure (an absolute pressure lower than the atmospheric pressure) at room temperature (Japanese Industrial Standards: 20° C.±15° C./JISZ8703). An example of such a refrigerant is a refrigerant including water, alcohol, or ether as a main component. When the heat pump apparatus 100 is in operation, the pressure of the inside of the heat pump apparatus 100 is lower than the atmospheric pressure. The pressure at the inlet of the compressor 31 is, for example, in the range of 0.5 to 5 kPaA. The pressure at the outlet of the compressor 31 is, for example, in the range of 5 to 15 kPaA. In order to prevent freezing or the like, a refrigerant including water, as a main component, and other components, such as ethylene glycol, Nybrine, and inorganic salts, in 10 to 40 mass %, may be used the refrigerant. The term "main component" refers to a component included in the refrigerant with the largest mass percent.

The first heat exchange unit 10 includes the ejector 11, a first extractor 12, a first pump 13, and a first heat exchanger 14. The ejector 11, the first extractor 12, the first pump 13, and the first heat exchanger 14 are connected through pipes 15*a* to 15*d* in this order in a ring-like shape.

The ejector 11 is connected to the first heat exchanger 14 through the pipe 15*d* and is connected to the compressor 31 through the vapor path 32. The refrigerant liquid flowing from the first heat exchanger 14 is supplied to the ejector 11 as a drive flow, and the refrigerant vapor compressed by the compressor 31 is supplied to the ejector 11 as a suction flow. The ejector 11 generates a merged refrigerant flow having a small quality (dryness) and supplies the merged refrigerant flow to the first extractor 12. The merged refrigerant flow is a refrigerant in a liquid phase or in a vapor-liquid two-phase with a very small quality. The pressure of the merged refrigerant flow discharged from the ejector 11 is higher than, for example, the pressure of the refrigerant vapor sucked into the ejector 11, and is lower than the pressure of the refrigerant liquid supplied to the ejector 11.

The first extractor 12 receives the merged refrigerant flow from the ejector 11 and extracts the refrigerant liquid from the merged refrigerant flow. In other words, the first extractor 12 serves as a vapor liquid separator that separates the refrigerant liquid and the refrigerant vapor from each other. Basically, the first extractor 12 extracts only the refrigerant liquid. The first extractor 12 includes, for example, a pressure-resistant container having a heat insulation property. However, the first extractor 12 may have any appropriate structure as long as the first extractor 12 can extract the refrigerant liquid. The pipes 15*b* to 15*d* form a liquid path 15 extending from the first extractor 12 to the ejector 11 via the first heat exchanger 14. The first pump 13 is disposed in the liquid path 15 at a position between a liquid outlet of the first extractor 12 and an inlet of the first heat exchanger 14. The first pump 13 moves the refrigerant liquid stored in the first extractor 12 to the first heat exchanger 14. The discharge pressure of the first pump 13 is lower than the atmospheric pressure. The first pump 13 is disposed at such a position that the available suction head, which is defined in consideration of the height from a suction port of the first pump 13 to a liquid surface in the first extractor 12, is greater than the required suction head (required NPSH). The first pump 13 may be disposed between an outlet of the first heat exchanger 14 and a liquid inlet of the ejector 11.

The first heat exchanger 14 is a heat exchanger of a known type, such as a fin tube heat exchanger or a shell tube heat exchanger. If the heat pump apparatus 100 is an air-conditioning apparatus for cooling air in a room, the first heat exchanger 14 is disposed outside of the room and heats air outside the room by using the refrigerant liquid.

The second heat exchange unit 20 includes an evaporator 21, a pump 22 (third pump), and a second heat exchanger 23. The evaporator 21 stores a refrigerant liquid and generates a refrigerant vapor, which is to be compressed by the compressor 31, by evaporating the refrigerant liquid. The evaporator 21, the pump 22, and the second heat exchanger 23 are connected to each other through pipes 24*a* to 24*c* in a ring-like shape. The evaporator 21 includes, for example, a pressure-resistant container having a heat insulation property. The pipes 24*a* to 24*c* form a circulation path 24, along which the refrigerant liquid stored in the evaporator 21 is circulated via the second heat exchanger 23. The pump 22 is disposed in the circulation path 24 at a position between a liquid outlet of the evaporator 21 and an inlet of the second heat exchanger 23. The pump 22 moves the refrigerant liquid stored in the evaporator 21 to the second heat exchanger 23. The discharge pressure of the pump 22 is lower than the atmospheric pressure. The pump 22 is disposed at such a position that the height from a suction port of the pump 22 to a liquid surface in the evaporator 21 is greater than the required suction head (required NPSH).

The second heat exchanger 23 is a heat exchanger of a known type, such as a fin tube heat exchanger or a shell tube heat exchanger. If the heat pump apparatus 100 is an air-conditioning apparatus for cooling air in a room, the second heat exchanger 23 is disposed inside of the room and cools air inside the room by using the refrigerant liquid.

In the present embodiment, the evaporator 21 is a heat exchanger that directly evaporates a refrigerant liquid, which has been heated while circulating along the circulation path 24, in the evaporator 21. The refrigerant liquid stored in the evaporator 21 directly contacts a refrigerant liquid circulating along the circulation path 24. In other words, a part of the refrigerant liquid in the evaporator 21 is heated by the second heat exchanger 23 and is used as a heat source for heating a refrigerant liquid in a saturated state. Preferably, an upstream end of the pipe 24*a* is connected to a lower part of the evaporator 21. Preferably, a downstream end the pipe 24*c* is connected to a middle part of the evaporator 21. The second heat exchange unit 20 may be structured so that a part of the refrigerant liquid stored in the evaporator 21 may not be mixed with another part of the refrigerant liquid circulating along the circulation path 24. For example, if the evaporator 21 is structured as a heat exchanger, such as a shell tube heat exchanger, it is possible to heat and evaporate the refrigerant liquid stored in the evaporator 21 by using a heating medium circulating along the circulation path 24. The heating medium, for heating the refrigerant liquid stored in the evaporator 21, flows through the second heat exchanger 23.

The vapor path 32 includes an upstream portion 32*a* and a downstream portion 32*b*. The compressor 31 is disposed in the vapor path 32. The upstream portion 32*a* of the vapor path 32 connects an upper part of the evaporator 21 to a suction port of the compressor 31. The downstream portion 32*b* of the vapor path 32 connects a discharge hole of the compressor 31 to the second nozzle 41 of the ejector 11. The compressor 31 is a centrifugal compressor or a positive-displacement compressor. A plurality of compressors may be disposed in the vapor path 32. The compressor 31 sucks in a refrigerant vapor from the evaporator 21 of the second heat exchange unit 20 through the upstream portion 32*a* and compresses the refrigerant vapor. The compressed refrigerant vapor is supplied to the ejector 11 through the downstream portion 32*b*.

With the present embodiment, the temperature and the pressure of the refrigerant are increased in the ejector 11. Thus, the work to be done by the compressor 31 can be reduced, and therefore the heat pump apparatus 100 can have an efficiency that is equivalent to or higher than those of existing heat pump apparatuses, while considerably reducing the compression ratio of the compressor 31. Moreover, the size of the heat pump apparatus 100 can be reduced.

The heat pump apparatus 100 is not limited to an air-conditioning apparatus that can perform only a cooling operation. A flow passage switching device, such as a four-way valve or a three-way valve, may be provided so that the first heat exchanger 14 can function as a heat exchanger for absorbing heat and the second heat exchanger 23 can function as a heat exchanger for releasing heat. In this case, an air-conditioning apparatus that can selectively perform a cooling operation and a heating operation can be obtained. The heat pump apparatus 100 is not limited to an air-conditioning apparatus and may be a different apparatus, such as a chiller or a heat storage apparatus. An object to be heated by the first heat exchanger 14 and an object to be cooled by the second heat exchanger 23 may be a gas other than air or a liquid.

A return path 33 for returning the refrigerant from the first heat exchange unit 10 to the second heat exchange unit 20 may be provided. An expansion mechanism 34, such as a capillary or an expansion valve, is disposed in the return path 33. In the present embodiment, the first extractor 12 is connected to the evaporator 21 through the return path 33 so that the refrigerant stored in the first extractor 12 can be transferred to the evaporator 21. Typically, a lower part of the first extractor 12 is connected to a lower part of the evaporator 21 through the return path 33. The refrigerant liquid is returned from the first extractor 12 to the evaporator 21 through the return path 33 while being decompressed by the expansion mechanism 34.

The return path 33 may branch off from any part of the first heat exchange unit 10. For example, the return path 33 may branch off from the pipe 15*a*, which connects the ejector 11 to the first extractor 12, or may branch off from an upper part of the first extractor 12. It is not necessary that the refrigerant be returned from the first heat exchange unit 10 to the second heat exchange unit 20. For example, the first heat exchange unit 10 may be structured so that a residual portion of the refrigerant can be discharged therefrom as necessary, and the second heat exchange unit 20 may be structured so that a refrigerant can be additionally supplied thereto as necessary.

The ejector and the heat pump apparatus disclosed in the present specification are particularly effective for use in, for example, the following devices: hot-water heaters using vapor; air-conditioning apparatuses, such as home air conditioners and office/factory air conditioners; and water heaters.

What is claimed is:

1. An ejector comprising:

a first nozzle to which a working fluid in a liquid phase is supplied;

a second nozzle into which a working fluid in a vapor phase is sucked;

an atomization mechanism that is disposed at an end of the first nozzle and that atomizes the working fluid in the liquid phase while maintaining the liquid phase; and a mixing space in which the atomized working fluid in the liquid phase generated in the atomization mechanism and the working fluid in the vapor phase sucked into the second nozzle are mixed to generate a merged fluid flow, wherein the atomization mechanism includes:

an orifice; and a collision plate that is disposed on an extended line of a center axial line of the orifice, wherein the collision plate has a collision surface that is inclined with respect to the center axial line of the orifice, and at least one point on a contour of the collision surface is disposed closer to a reference point than a second reference line in a projection view that is obtained by orthogonally projecting the collision plate on to a projection plane, where the reference point is an intersection of the extended line of the center axial line of the orifice with the collision surface, a reference plane is a plane that includes the center axial line of the orifice and that perpendicularly intersects with the collision surface, a collision end point is an intersection of the reference plane with the contour of the collision surface, a first reference line is a line segment that connects the reference point with the collision end point, the second reference line is a line that includes the collision end point and that is perpendicular to the first reference line in the projection view, and the projection plane is a plane that includes the first reference line and that is perpendicular to the reference plane.

2. The ejector according to claim 1, wherein, in the projection of the collision plate, a distance from the contour of the collision surface to the second reference line increases continuously or stepwise with increasing distance from the collision end point.

3. The ejector according to claim 1, wherein, in the projection of the collision plate, a maximum distance from the contour of the collision surface to the second reference line is less than or equal to a length of the first reference line.

4. A heat pump apparatus comprising:

a compressor that compresses a refrigerant vapor;

a heat exchanger through which a refrigerant liquid flows;

the ejector according to claim 1, the ejector generating a merged refrigerant flow by using the refrigerant vapor compressed by the compressor and the refrigerant liquid flowing from the heat exchanger;

an extractor that receives the merged refrigerant flow from the ejector and that extracts the refrigerant liquid from the merged refrigerant flow;

a liquid path that extends from the extractor to the ejector via the heat exchanger; and an evaporator that stores the refrigerant liquid and that generates the refrigerant vapor, which is to be compressed by the compressor, by evaporating the refrigerant liquid.

5. The heat pump apparatus according to claim 4, wherein a pressure of the merged refrigerant flow discharged from the ejector is higher than a pressure of the refrigerant vapor sucked into the ejector and lower than a pressure of the refrigerant liquid supplied to the ejector.

6. The heat pump apparatus according to claim 4, wherein the refrigerant is a refrigerant whose saturated vapor pressure at room temperature is a negative pressure.

7. The heat pump apparatus according to claim 4, wherein the refrigerant includes water as a main component.

* * * * *